US011111608B2

(12) United States Patent
Merati

(10) Patent No.: US 11,111,608 B2
(45) Date of Patent: Sep. 7, 2021

(54) PRODUCTION OF SLIVERS OF MILKWEED FIBERS

(71) Applicant: Ali Akbar Merati, Tehran (IR)

(72) Inventor: Ali Akbar Merati, Tehran (IR)

(73) Assignees: Ali Akbar Merati; AMIRKABIR UNIVERSITY OF TECHNOLOGY

( * ) Notice: Subject to any disclaimer, the term of this patent is extended or adjusted under 35 U.S.C. 154(b) by 417 days.

(21) Appl. No.: 15/881,716

(22) Filed: Jan. 26, 2018

(65) Prior Publication Data

US 2018/0187339 A1 Jul. 5, 2018

(51) Int. Cl.

| | |
|---|---|
| ***D01G 15/40*** | (2006.01) |
| ***D01G 15/74*** | (2006.01) |
| ***D02G 3/02*** | (2006.01) |
| ***D01G 99/00*** | (2010.01) |

(52) U.S. Cl.

CPC ..... *D01G 15/40* (2013.01); *D01G 15/74* (2013.01); *D01G 99/00* (2013.01); *D02G 3/02* (2013.01); *D10B 2201/01* (2013.01)

(58) Field of Classification Search

CPC ..... D01G 15/40; D01G 15/74; D01G 99/00; D02G 3/02; D01B 1/10; D01B 1/14; D01B 1/00–50; D10B 2201/01

See application file for complete search history.

(56) References Cited

U.S. PATENT DOCUMENTS

| | | | | |
|---|---|---|---|---|
| 2,160,001 | A * | 5/1939 | Saborsky | D01G 99/00 428/74 |
| 2,202,030 | A * | 5/1940 | Siegfried | D02G 3/18 19/150 |
| 4,161,052 | A | 7/1979 | Erben | |
| 4,176,988 | A * | 12/1979 | Lattmann | D01G 23/02 19/105 |
| 4,240,180 | A | 12/1980 | Wood et al. | |
| 4,318,721 | A * | 3/1982 | Barr | A47L 9/108 55/290 |
| 4,403,374 | A * | 9/1983 | Wood | D04H 1/72 19/105 |
| 5,134,863 | A | 8/1992 | Hanna | |
| 6,079,647 | A * | 6/2000 | Leduc | D01B 1/16 19/24 |
| 2017/0144164 | A1* | 5/2017 | Lovas | B07B 1/18 |
| 2018/0187339 | A1* | 7/2018 | Merati | D01G 15/40 |

FOREIGN PATENT DOCUMENTS

| | | | |
|---|---|---|---|
| JP | 01321903 | * | 6/1988 |

* cited by examiner

*Primary Examiner* — Clinton T Ostrup
*Assistant Examiner* — Andrew Wayne Sutton
(74) *Attorney, Agent, or Firm* — NovoTechIP International PLLC

(57) ABSTRACT

A method and apparatus for producing continuous web or sliver of milkweed fibers without the use of conventional carding machines is disclosed. The method generally includes feeding raw materials including milkweed fibers into the apparatus, transferring the milkweed fibers to a sliver collecting net, and producing the slivers on the surface of the sliver collecting net. The slivers can be separated from the sliver collecting net.

11 Claims, 5 Drawing Sheets

PRODUCTION OF SLIVERS OF MILKWEED FIBERS

TECHNICAL FIELD

The present disclosure relates generally to the production of sliver of fibers. More specifically, the present application relates to a mechanized production of sliver of milkweed fibers method and apparatus.

BACKGROUND

Modernization efforts have brought major changes to the U.S. textile industry. Equipment has been streamlined and many operations have been fully automated with computers. The milkweed plant produces a fiber that can be used by spinners. Fibers from hemp, flax, dogbane, milkweed and nettle have been used for thousands of years to produce textiles, cordage, netting, etc.

Common milkweed, *Asclepias syriaca*, is a perennial crop traditionally considered a nuisance weed by farmers throughout the Midwest U.S. The production of milkweed for floss and seed could provide local farmers with a new crop option that provides annual returns with minimal maintenance. The market for milkweed fibers, seed, meal, and oil are developing rapidly as new uses for milkweed products are found. Traditionally, common milkweed floss was used as filling in life jackets during World War II and the seed of the milkweed has been cultivated as monarch butterfly habitat in prairies and preserves throughout the United States. Currently, the Natural Fibers Corporation based in Ogallala, Nebr. is manufacturing comforters and pillows made from milkweed fibers. The floss has a higher thermal rating than goose down and is hypoallergenic. Other parts of the plant also have potential uses in latex production, nematicide applications, and the cosmetics industry.

Grown commercially since 2012, particularly in Quebec, *Asclepias* is also known as "Silk of America". Silk of America is a strand of common milkweed (*Asclepias syriaca*) gathered mainly in the valley of the Saint Lawrence River in Canada. The silk is used to manufacture thermal insulation, acoustic insulation and oil absorbents.

SUMMARY

This summary is intended to provide an overview of the subject matter of the present disclosure, and is not intended to identify essential elements or key elements of the subject matter, nor is it intended to be used to determine the scope of the claimed implementations. The proper scope of the present disclosure may be ascertained from the claims set forth below in view of the detailed description below and the drawings.

In one general aspect, the present disclosure is directed to an apparatus for the production of slivers of milkweed fibers that includes an inlet configured to receive air and raw materials, where the raw materials include milkweed fibers, and a blower fan, the blower fan being disposed along the top of the apparatus, and the blower fan is configured to aerate and align the milkweed fibers. In addition, the apparatus includes a sliver collecting net, where slivers of milkweed fibers are retained by the net as air exits the apparatus through the net, as well as a plurality of gaps, where the gaps are located along a bottom portion of the apparatus, and milkweed seeds and other impurities present in the raw materials that are heavier than the milkweed fibers precipitate and pass through the gaps.

The above general aspect may include one or more of the following features. For example, the sliver collecting net may be approximately 600 mm in diameter and approximately 40 mm in height. In another example, the plurality of gaps includes three gaps, where each gap is approximately 2 mm in width, and the plurality of gaps are spaced apart by a distance of approximately 70 mm. In some cases, the blower fan dimensions are approximately 103 mm×160 mm×160 mm. Furthermore, in one implementation, the blower fan operates at approximately 2300 rpm and aerates at a rate of approximately 210 $m^3$/h. in some implementations, the bottom portion of the apparatus is tilted at an angle of approximately 10 degrees. As another example, the milkweed seeds and impurities may be separated from the milkweed fibers through aeration of the raw materials by the blower fan.

In another general aspect, the present disclosure is directed to a method for producing sliver of milkweed fibers. The method can include feeding raw materials into a top portion of the apparatus, the raw materials including milkweed fibers, and transferring the milkweed fibers to a surface of a sliver collecting net through an air stream, thereby aligning the fibers. The method can further include producing slivers of the milkweed fibers on the surface of the sliver collecting net, and separating the slivers of the milkweed fibers from the sliver collecting net.

The above general aspect may include one or more of the following features. For example, an air stream may be used to decrease tension force on the milkweed fibers. As another example, a bottom portion of the apparatus can be tilted at an angle of approximately 10 degrees. In some cases, the raw materials are fed to the apparatus manually. In some implementations, the slivers of the milkweed fibers are separated from the sliver collecting net manually.

Other systems, methods, features and advantages of the implementations will be, or will become, apparent to one of ordinary skill in the art upon examination of the following figures and detailed description. It is intended that all such additional systems, methods, features and advantages be included within this description and this summary, be within the scope of the implementations, and be protected by the following claims.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

In the following detailed description, numerous specific details are set forth by way of examples in order to provide a thorough understanding of the relevant teachings. However, it should be apparent that the present teachings may be practiced without such details. In other instances, well known methods, procedures, components, and/or circuitry have been described at a relatively high-level, without detail, in order to avoid unnecessarily obscuring aspects of the present teachings. The following detailed description is presented to enable a person skilled in the art to make and use the methods and devices disclosed in exemplary embodiments of the present disclosure. For purposes of explanation, specific nomenclature is set forth to provide a thorough understanding of the present disclosure. However, it will be apparent to one skilled in the art that these specific details are not required to practice the disclosed exemplary embodiments. Descriptions of specific exemplary embodiments are provided only as representative examples. Various modifications to the exemplary implementations will be readily apparent to one skilled in the art, and the general principles defined herein may be applied to other implementations and applications without departing from the scope of the present disclosure. The present disclosure is not intended to be limited to the implementations shown, but is to be accorded the widest possible scope consistent with the principles and features disclosed herein.

During the production of textiles, lint from several bales is mixed and blended together to provide a uniform blend of fiber properties. The blended lint is blown by air from the feeder through chutes to cleaning and carding machines that separate and align the fibers into a thin web. Carding machines can process cotton in excess of 200 pounds per hour. The web of fibers at the front of the card is then drawn through a funnel-shaped device called a trumpet, providing a soft, rope-like strand called a "sliver".

For purposes of this disclosure, carding refers to a mechanical process that disentangles, cleans, and/or intermixes fibers to produce a continuous web or sliver suitable for subsequent processing. This is achieved by passing the fibers between differentially moving surfaces covered with card clothing. The carding process breaks up locks and unorganized clumps of fiber and then aligns the individual fibers to be parallel with each other. In preparing wool fiber for spinning, for example, carding is the step that comes after teasing.

Figure 1:
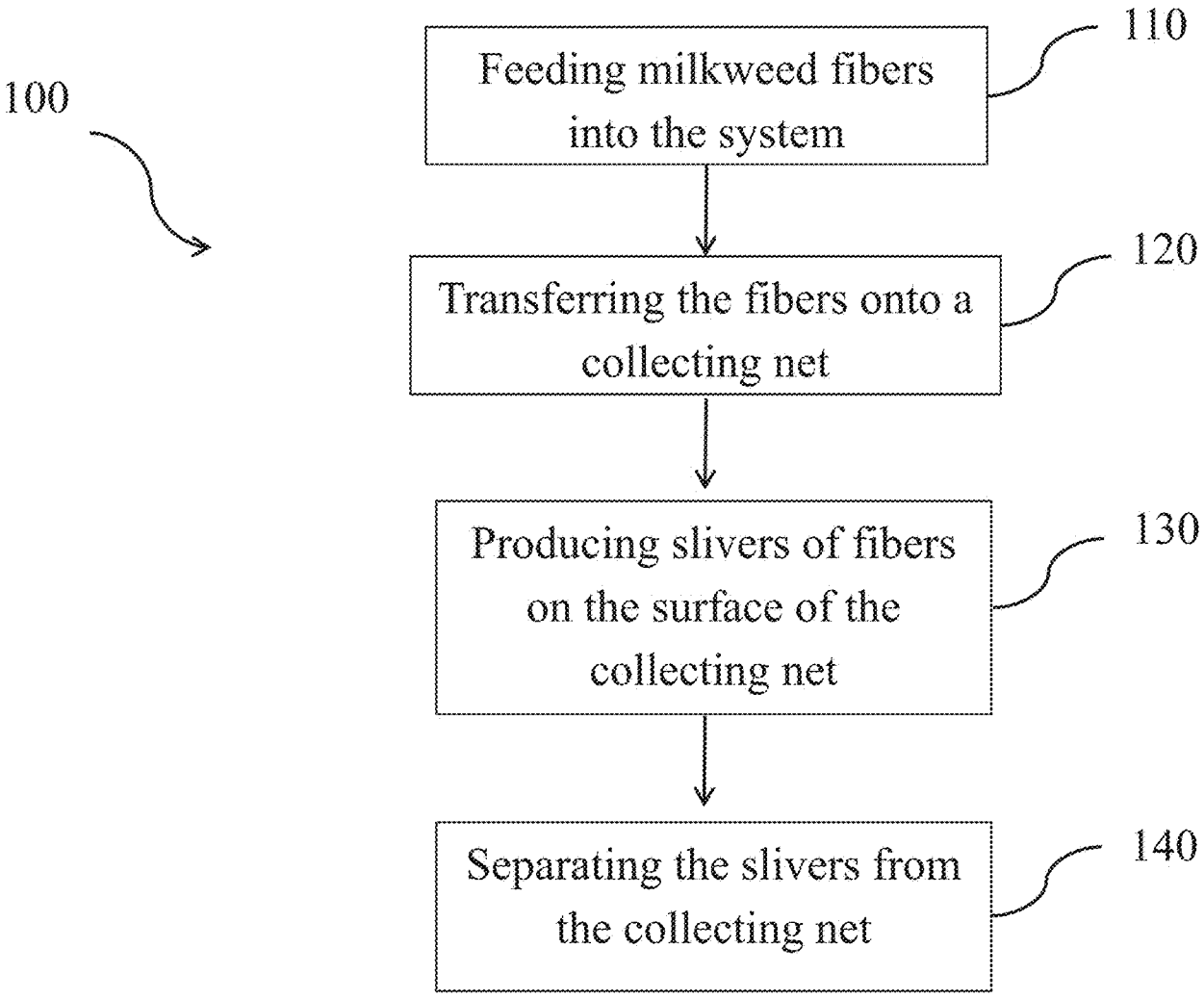
FIG. 1 is a flow diagram depicting an implementation of a method of producing a continuous web or sliver.

The present application is directed to a process and an apparatus for the production of a continuous web or sliver, without the use of a conventional carding machine. Referring to FIG. 1, one implementation of a method 100 of producing continuous web or sliver without using conventional carding machine is presented. As shown in FIG. 1, method 100 can include four stages. A first step 110 can include feeding raw materials, such as milkweed fibers, manually into the system. A second step 120 can include transferring or directing the fibers toward and/or onto a sliver collecting net. In this stage, an air stream can be used to move and/or align the fibers. Using air stream rather than relying on a mechanical handling of the fibers can increase the friction without tension force on the thin and vulnerable fibers. A third step 130 can include producing, accumulating and/or gathering the slivers on a surface of the sliver collecting net. A fourth step 140 can include manual or automated separation of the slivers of milkweed fibers from the sliver collecting net.

Figure 2A:
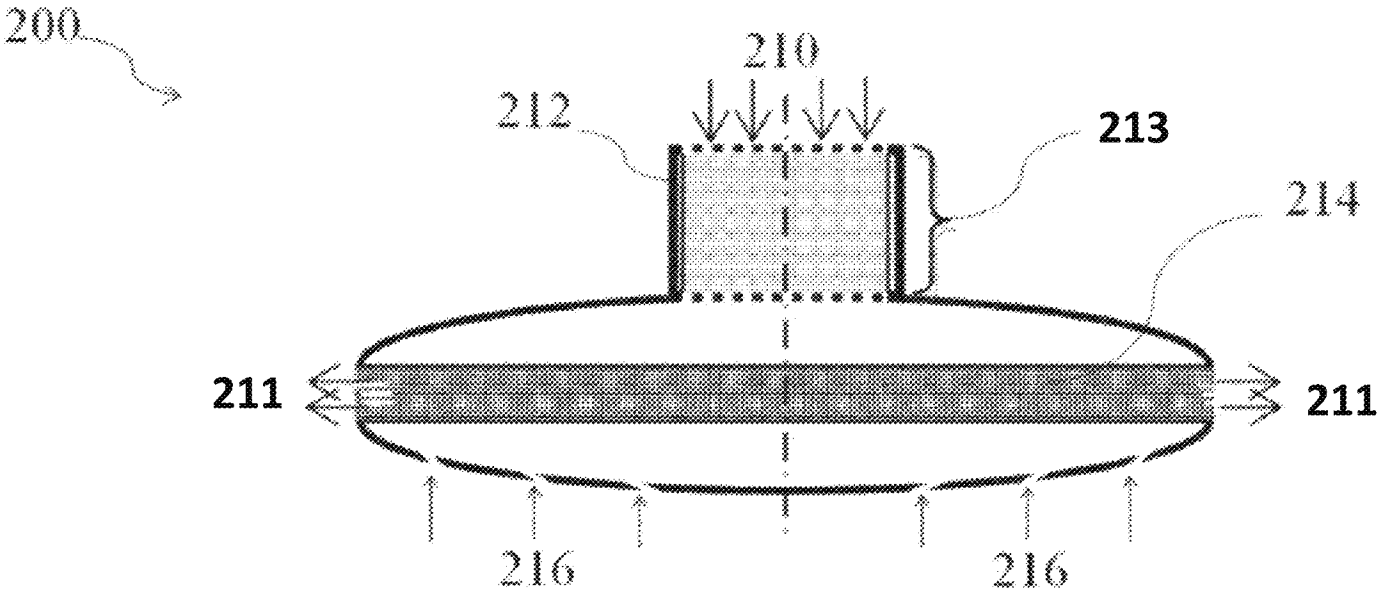
FIG. 2A illustrates a schematic of a side view of a sliver of milkweed fibers apparatus, according to an implementation of the instant application.
Figure 2B:
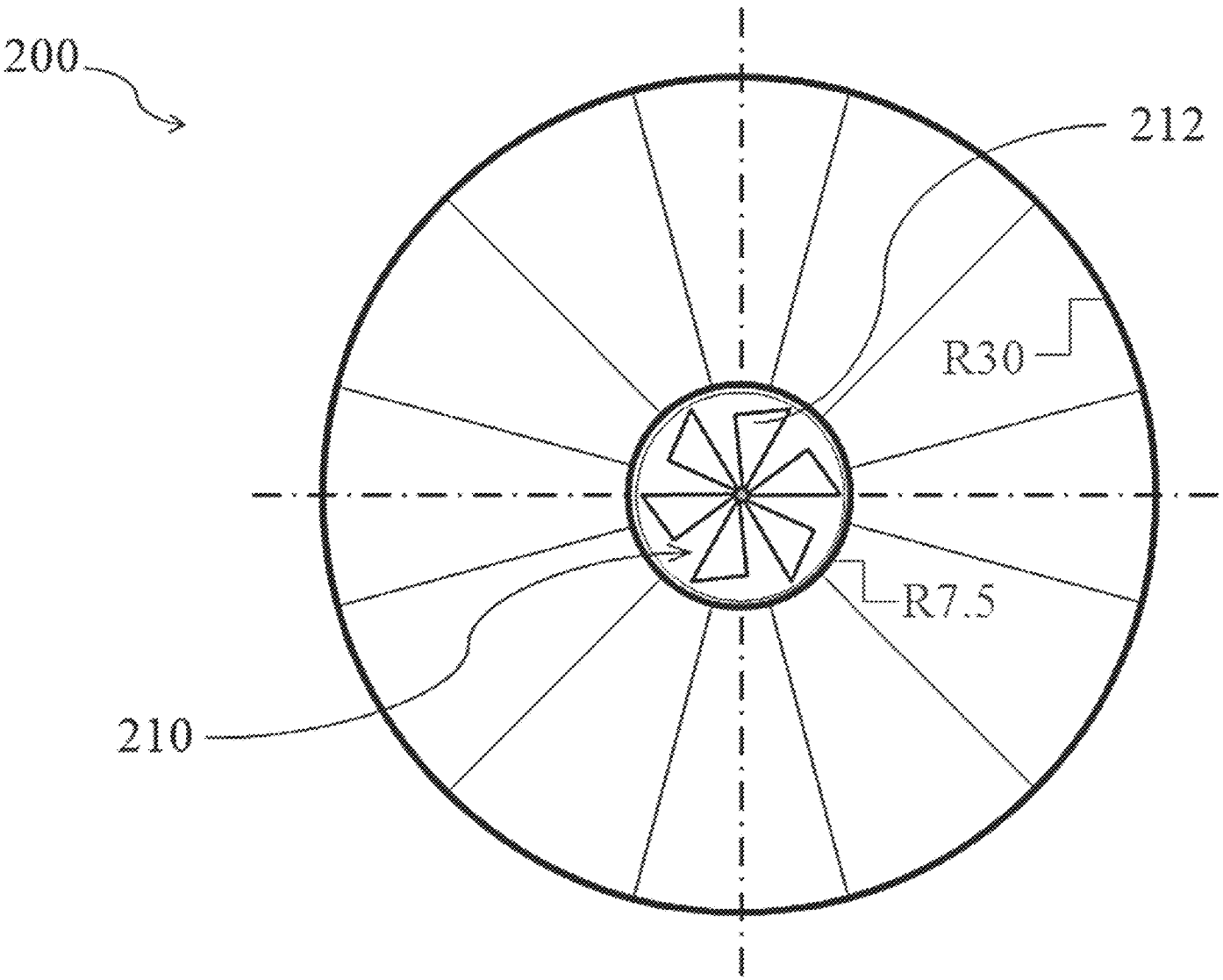
FIG. 2B illustrates a schematic of a top-down view of the sliver of milkweed fibers apparatus of FIG. 2A, according to an implementation of the instant application.

Referring now to FIGS. 2A and 2B, an apparatus 200 for production of continuous web or sliver is depicted. The apparatus 200 should be understood to operate without the use of a conventional carding machine in some implementations. In one implementation, the apparatus 200 can include: an air and fiber inlet ("inlet") 210, a blower fan 212, an aeration channel 213, an air outlet/sliver collecting net ("collecting net") 214, and a plurality of gaps ("gaps") 216. Gaps 216 can be used to separate impurities from the product in some implementations. For purposes of clarity, a top-down view of the apparatus 200 is also presented in FIG. 2B.

In some implementations, air and raw materials that include individual milkweed fibers can enter the apparatus 200 through the inlet 210. The dimensions of the inlet 210 can vary in different implementations. In some implementations, the inlet 210 is between 100 mm and 200 mm in diameter. In one implementation, the inlet 210 has a diameter of approximately 150 mm, as represented in FIG. 2A. Furthermore, the thickness of the inlet 210 can vary between 5 mm and 20 mm in different implementations. In other implementations, the thickness of the inlet 210 can be less than 5 mm or greater than 20 mm. In FIG. 2A, it can be understood that the inlet 210 thickness is approximately 10 mm thick. After the fibers have entered the apparatus 200, they can pass through the aeration channel 213. The length of the aeration channel 213 can vary in different implementations. For example, in some implementations, aeration channel 213 has a length between 50 mm and 175 mm. In the implementation depicted in FIG. 2A, the aeration channel 213 has a length of 103 mm.

During the stage in which the fibers are disposed in the aeration channel 213, the blower fan 212 can be utilized to keep the fibers substantially afloat. This allows the fibers to become aligned without exerting a mechanical force. The blower fan 212 can have different dimensions in different implementations. For example, in some implementations, the blower fan 212 has a diameter between 100 mm and 200 mm, and a height ranging between 75 mm and 150 mm. In the implementation depicted in FIG. 2A, the blower fan 212 has a diameter of 160 mm and a length of 103 mm. In one implementation, the dimensions of the blower fan 212 are approximately 103 mm×160 mm×160 mm.

Furthermore, in some implementations, the rate at which the blower fan 212 operates can be adjusted to improve the performance of the apparatus 200. For example, in some implementations, the blower fan 212 is operated between 1500 rpm and 3000 rpm to aerate the milkweed fibers. In one exemplary implementation, the blower fan 212 operates or runs at approximately 2300 rpm, and aerates at a rate of approximately 210 $m^3/h$, which allows the milkweed fibers to float and become substantially aligned. It can be understood that the use of a continuous air stream can serve to decrease the tension force(s) exerted on the milkweed fibers relative to the conventional use of mechanical handling of the fibers and/or carding machines.

In some implementations, the apparatus 200 is a metallic chamber. Within the apparatus 200, the sliver collecting net 214 can vary in size. For example, in some cases, collecting net 214 is between 20 cm and 200 cm in diameter. In one exemplary implementation, collecting net 214 is approximately 60 cm in diameter with a 10-degree slope. This slope can help with the separation of impurities of different densities from the milkweed fibers. Therefore, through the use of collecting net 214, the separated slivers are richer in milkweed fibers.

In addition, in some implementations, the height or thickness of the sliver collecting net 214 can vary, for example, between 20 mm and 80 mm. In one exemplary implementation, the collecting net 214 has a 40 mm height. Thus, in one implementation, slivers of milkweed fibers are retained by the net 214 as air exits at 211 the apparatus 200 through the net.

The diameter of the chamber can vary between 300 mm and 900 mm. With respect to FIG. 2A, the chamber diameter is approximately 600 mm. Furthermore, in different implementations, the apparatus 200 can be associated with the plurality of gaps 216. The gaps 216 are disposed or located along a bottom portion of the apparatus 200 (see FIG. 2A). These gaps 216 can differ in size and number, depending on the type of impurities that are being filtered. For example, in one implementation, the gaps 216 may include three gaps, each with an approximately 2 mm width. In some implementations, the plurality of gaps are spaced apart by a distance of approximately 70 mm. In other implementations, the arrangement, spacing, and/or number of gaps can differ.

In some implementations, milkweed seeds and other impurities present in the raw materials that are heavier than the milkweed fibers precipitate and pass through the gaps 216. Thus, the apparatus is configured to separate a variety of impurities from the milkweed fibers through the use of the gaps 216. As air exits at 211 the apparatus 200 through the air outlet/sliver collecting net 214, the gaps 216 operate to separate or filter the collected impurities due to the different densities and sizes of the impurities relative to milkweed fibers. For example, because milkweed seeds (a type of impurity) are typically 1-1.4 mm in diameter, they will pass through the gaps 216 can be separated from the milkweed fibers.

As noted above, while air passes through the air outlet/sliver collecting net 214, the aligned milkweed fibers are retained there. In some implementations, the aligned milkweed fibers can be collected manually, though in other implementations, collection may be automated. In one exemplary implementation, a continuous sliver of fiber is produced by the apparatus 200. In other embodiments, the apparatus 200 can be tilted at varying degrees to improve the efficiency of the system. For example, in one exemplary implementation, the bottom portion of the apparatus is tilted at an angle of approximately 10 degrees. In other implementations, the bottom of the apparatus can be tilted along a wide range of angles as best suited to the operation of the device and type and/or length of slivers. It should be noted that during the production of the slivers of milkweed fibers, no chemical materials are used to increase friction and improve alignment. Furthermore, the disclosed apparatus may be used to produce mixtures of slivers with different lengths.

Figure 3B:
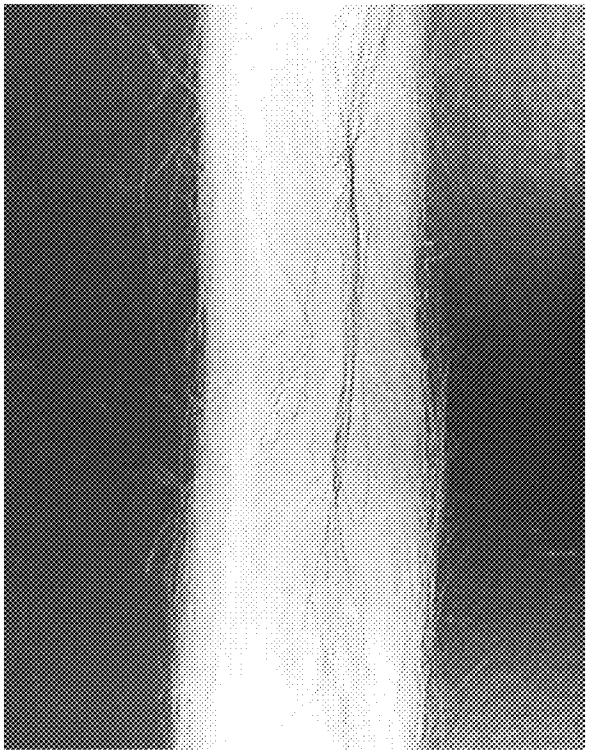
FIG. 3B is an image providing an example of a milkweed sliver with a black tracer fiber on the sliver produced by the apparatus as disclosed herein.
Figure 3A:
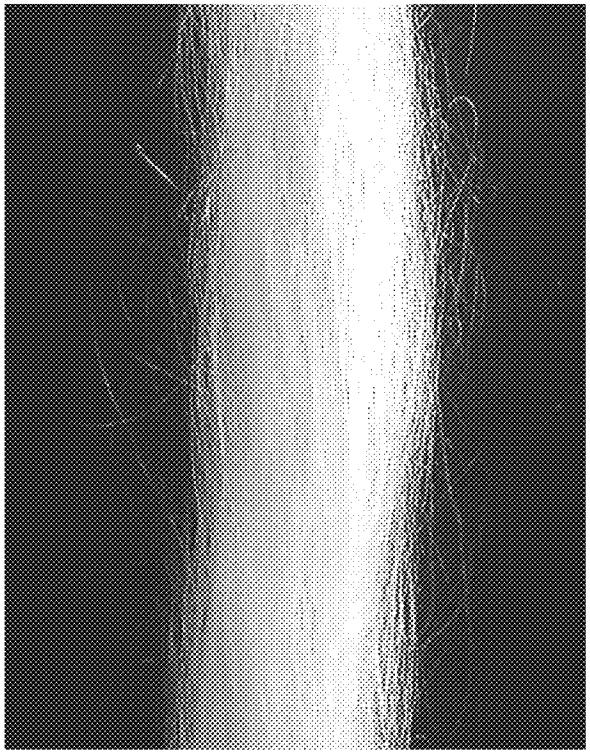
FIG. 3A is an image providing an example of a milkweed sliver produced by the apparatus as disclosed herein.
Figure 4:
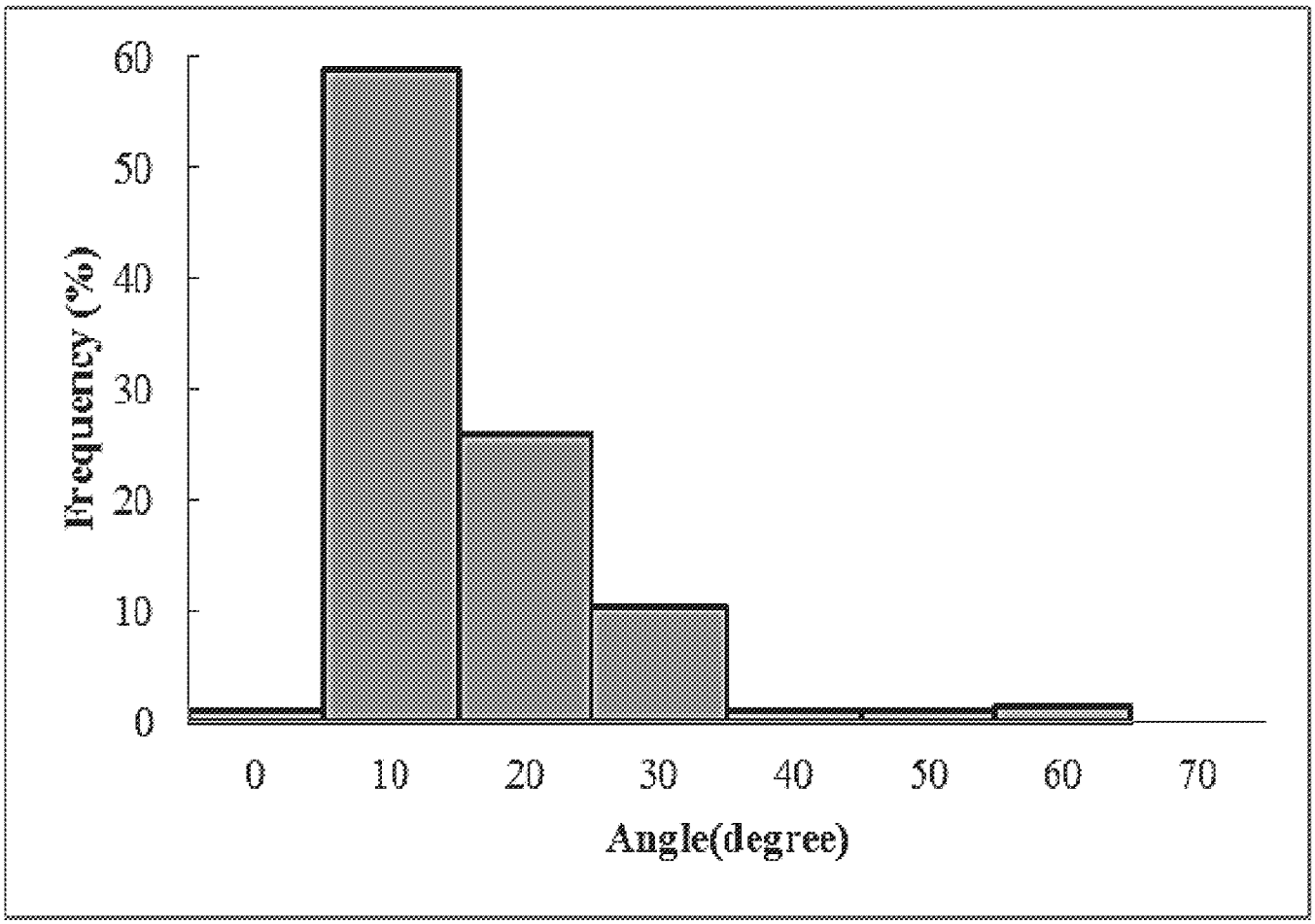
FIG. 4 depicts a histogram of the angle between the sliver axis and the milkweed sliver fibers axis, according to an implementation of the instant application.

Referring now to FIGS. 3A and 3B, two images are presented to better illustrate the disclosed implementations. FIG. 3A depicts an image of typical milkweed sliver, while FIG. 3B depicts milkweed sliver made according to an implementation of the present application. For purposes of clarity, some individual milkweed fibers were dyed and used as tracers. The results indicate that the slivers of milkweed fibers that are collected from the apparatus 200 (see FIG. 2A) are substantially well-aligned. Thus, the use of a blower fan as disclosed herein, without using conventional carding machine, provided excellent results. This is further established by FIG. 4. In FIG. 4, a histogram of the angle between the sliver axis and the milkweed fibers axis is depicted. It can be seen that 70% of the milkweed fibers are less than 10 degrees misaligned with the fibers axis.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various implementations. This is for purposes of streamlining the disclosure, and is not to be interpreted as reflecting an intention that the claimed implementations require more features than are expressly recited in each claim. Rather, as the following claims reflect, inventive subject matter lies in less than all features of a single disclosed implementation. Thus, the following claims are hereby incorporated into the Detailed Description, with each claim standing on its own as a separately claimed subject matter.

While various implementations have been described, the description is intended to be exemplary, rather than limiting and it will be apparent to those of ordinary skill in the art that many more implementations and implementations are possible that are within the scope of the implementations. Although many possible combinations of features are shown in the accompanying figures and discussed in this detailed description, many other combinations of the disclosed features are possible. Any feature of any implementation may be used in combination with or substituted for any other feature or element in any other implementation unless specifically restricted. Therefore, it will be understood that any of the features shown and/or discussed in the present disclosure may be implemented together in any suitable combination. Accordingly, the implementations are not to be restricted except in light of the attached claims and their equivalents. Also, various modifications and changes may be made within the scope of the attached claims.

What is claimed is:

1. An apparatus to produce slivers of milkweed fibers comprising:

an inlet configured to receive air and raw materials, the raw materials including milkweed fibers and impurity components, wherein the impurity components are heavier than the milkweed fibers;

a blower fan, the blower fan being disposed along a top portion of the apparatus, the blower fan being configured to aerate the milkweed fibers by floating the raw materials;

a sliver collecting net, wherein slivers of milkweed fibers are retained by the sliver colleting net as air exits the apparatus through the net, and wherein the impurity components pass through the sliver collecting net; and a plurality of gaps, wherein:

the plurality of gaps are located along a bottom portion of the apparatus, and wherein the impurity components precipitate and pass through the plurality of gaps and the blower fan is configured to operate at approximately 2300 rpm and to aerate at a rate of approximately 210 $m^3/h$.

2. The apparatus of claim 1, wherein the sliver collecting net is approximately 600 mm in diameter and approximately 40 mm in height.

3. The apparatus of claim 1, wherein the plurality of gaps comprise three gaps, wherein each gap is approximately 2 mm in width, and wherein the plurality of gaps are spaced apart by a distance of approximately 70 mm.

4. The apparatus of claim 1, wherein the blower fan dimensions are approximately 103 mm×160 mm×160 mm.

5. The apparatus of claim 1, wherein the bottom portion of the apparatus is tilted at an angle of approximately 10 degrees.

6. The apparatus of claim 1, wherein the milkweed seeds and impurities are separated from the milkweed fibers through aeration of the raw materials by the blower fan.

7. A method for producing sliver of milkweed fibers comprising:

feeding raw materials into a top portion of an apparatus, the raw materials comprising milkweed fibers and impurity components, wherein the impurity components are heavier than the milkweed fibers;

transferring the milkweed fibers to a surface of a sliver collecting net by aerating the raw materials;

producing the slivers of milkweed fibers on the surface of the sliver collecting net; and separating the slivers of milkweed fibers from the sliver collecting net, wherein the impurity components pass through the sliver collecting net and precipitate through a plurality of gaps located below the sliver collecting net.

8. The method of claim 7, wherein aerating the raw materials is used to decrease a tension force on the milkweed fibers.

9. The method of claim 7, wherein a bottom portion of the apparatus is tilted at an angle of approximately 10 degrees.

10. The method of claim 7, wherein the raw materials are fed to the apparatus manually.

11. The method of claim 7, wherein the slivers of the milkweed fibers are separated from the sliver collecting net manually.

* * * * *